US006431809B1

(12) United States Patent
Teich

(10) Patent No.: US 6,431,809 B1
(45) Date of Patent: Aug. 13, 2002

(54) METHOD FOR STORING SPOOLS, AND STORAGE DEVICE

(75) Inventor: Udo Teich, Bobingen-Strassberg (DE)

(73) Assignee: Certus Maschinenbau GmbH (DE)

( * ) Notice: Subject to any disclaimer, the term of this patent is extended or adjusted under 35 U.S.C. 154(b) by 0 days.

(21) Appl. No.: 09/530,030

(22) PCT Filed: Oct. 30, 1997

(86) PCT No.: PCT/EP97/05993

§ 371 (c)(1),
(2), (4) Date: Apr. 20, 2000

(87) PCT Pub. No.: WO99/23023

PCT Pub. Date: May 14, 1999

(51) Int. Cl.[7] ..... B65G 1/00

(52) U.S. Cl. ..... 414/286; 414/279; 414/281; 414/282; 242/35.5 A

(58) Field of Search ..... 494/286, 278, 494/279, 281, 282, 807; 57/3, 18, 266, 268, 270, 281; 242/35.5 A

(56) References Cited

U.S. PATENT DOCUMENTS

| | | | | |
|---|---|---|---|---|
| 1,688,273 A | | 10/1928 | Hawley et al. | |
| 1,769,913 A | | 7/1930 | Bennett | |
| 2,297,667 A | | 9/1942 | Winslow | |
| 2,466,861 A | | 4/1949 | Peterson | |
| 2,497,574 A | | 2/1950 | Bahnson | |
| 3,432,118 A | | 3/1969 | Carruthers | |
| 4,144,961 A | * | 3/1979 | Kasahara et al. | 242/35.5 A |
| 4,764,078 A | | 8/1988 | Neri | |
| 5,129,206 A | * | 7/1992 | Kidani et al. | |

FOREIGN PATENT DOCUMENTS

| | | | |
|---|---|---|---|
| DE | 491675 | | 8/1960 |
| DE | 25 03 914 A1 | | 8/1976 |
| DE | 90 11 878.2 | | 1/1991 |
| DE | 42 04 358 A1 | | 8/1993 |
| DE | 29704497 | * | 8/1997 |
| EP | 0 376 833 A1 | | 7/1990 |
| EP | 531910 | * | 9/1992 |

* cited by examiner

*Primary Examiner*—Joseph E. Valenza
(74) *Attorney, Agent, or Firm*—McGlew and Tuttle, P.C.

(57) ABSTRACT

The invention relates to a device and a method for storing spools 3, especially filament spools, comprising several spool carriers 2. According to the invention, the spools 3 are stored with an upright spool axis 6 in a shelf storage unit 1 with horizontal shelf compartments 17 for receiving individually movable spool carriers.

22 Claims, 6 Drawing Sheets

METHOD FOR STORING SPOOLS, AND STORAGE DEVICE

FIELD OF THE INVENTION

The present invention pertains to a process for the storage of spools and a storing means for spools, especially for filament spools, with a plurality of said spool carriers.

BACKGROUND OF THE INVENTION

Such a storing means has become known from practice. It is designed for highly sensitive filament spools that are manufactured in a spinning mill. The filament spools consist of a hollow spool core, onto which a filament winding of yarn or fibers is applied. The prior-art storing means possesses a plurality of spool carriers which consist of long, horizontally arranged rods, onto which a number of spools are loaded one behind the other with the spool cores. The spool carriers are fastened to a stationary or circulating support framework. The prior-art storing means has, on the one hand, the disadvantage that the spools cannot be taken over by the spool carriers individually, but only in the multibay pack. Moreover, the freely projecting spool carrier rods are deformed under the weight of the spools, which leads to positioning errors during the loading and unloading. Further, the storage capacity is limited. Moreover, the removal and packaging are complicated.

SUMMARY AND OBJECTS OF THE INVENTION

The object of the present invention is to show an improved storing means.

According to the invention, a process is provided for storing spools, especially filament spools, with a plurality of spool carriers. The spools are stored with a stationary spool axis in a shelf storing means with horizontal bays for the accommodation of the individually movable spool carriers.

The storing technique according to the present invention has the advantage that the spools are able to be handled in a considerably improved and safer manner. Each spool can be accessed separately. Thus, the embodiment as a shelf storing means has the advantage that in spite of the separate access, the storage capacity is at least as great as in the state of the art. The previously known positioning and conveying problems are solved. Overall, a markedly improved storing technique is obtained in conjunction with a very low space requirement.

In contrast to the state of the art the spools are stored lying on the spool carriers. It is recommended here to design the spool carriers as pallet-like shelves or as so-called multitrays and to arrange a number of spools thereon. The spools are stored separately on pins. This also makes unloading easier and especially makes possible a cinematically favorable access to the individual spools from above.

The spool carriers can be brought from their horizontal position, which is favorable in terms of their storage, into a vertical position via a turning means. The latter is advantageous for their conveying within the adjacent areas of the spinning mill for space reasons. Moreover, in the vertical position, the spools can be delivered by an external conveying carrier to a spool carrier remaining within the shelf storing means and circulating there.

The storing technique according to the present invention also makes it possible to handle the spools, which are sensitive to contact and contamination, in an especially gentle manner. It is advantageous for this reason to separate the individual shelf bays from one another and to prevent contamination thereby. In addition, separated conveying surfaces prevent contamination on the spool carriers.

For removal, it is advantageous to again isolate the spools grouped on the spool carrier. The spools may thus be individually placed on so-called monotrays and be individually further conveyed. The isolation has the advantage that before the packaging an inspection of the spools as well as a sorting according to various criteria, e.g., according to grade, color, etc. may take place. Spools of different grades are possibly stored on the spool carrier. Pure-grade batches must usually be prepared during the packaging. This may be done comfortably via the isolation. Moreover, the spools may again be grouped into new bundles by the monotrays, and fed to the packaging means in a favorable number and arrangement. Furthermore, during the isolation, another, series-connected foil packaging of the individual spools may take place.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
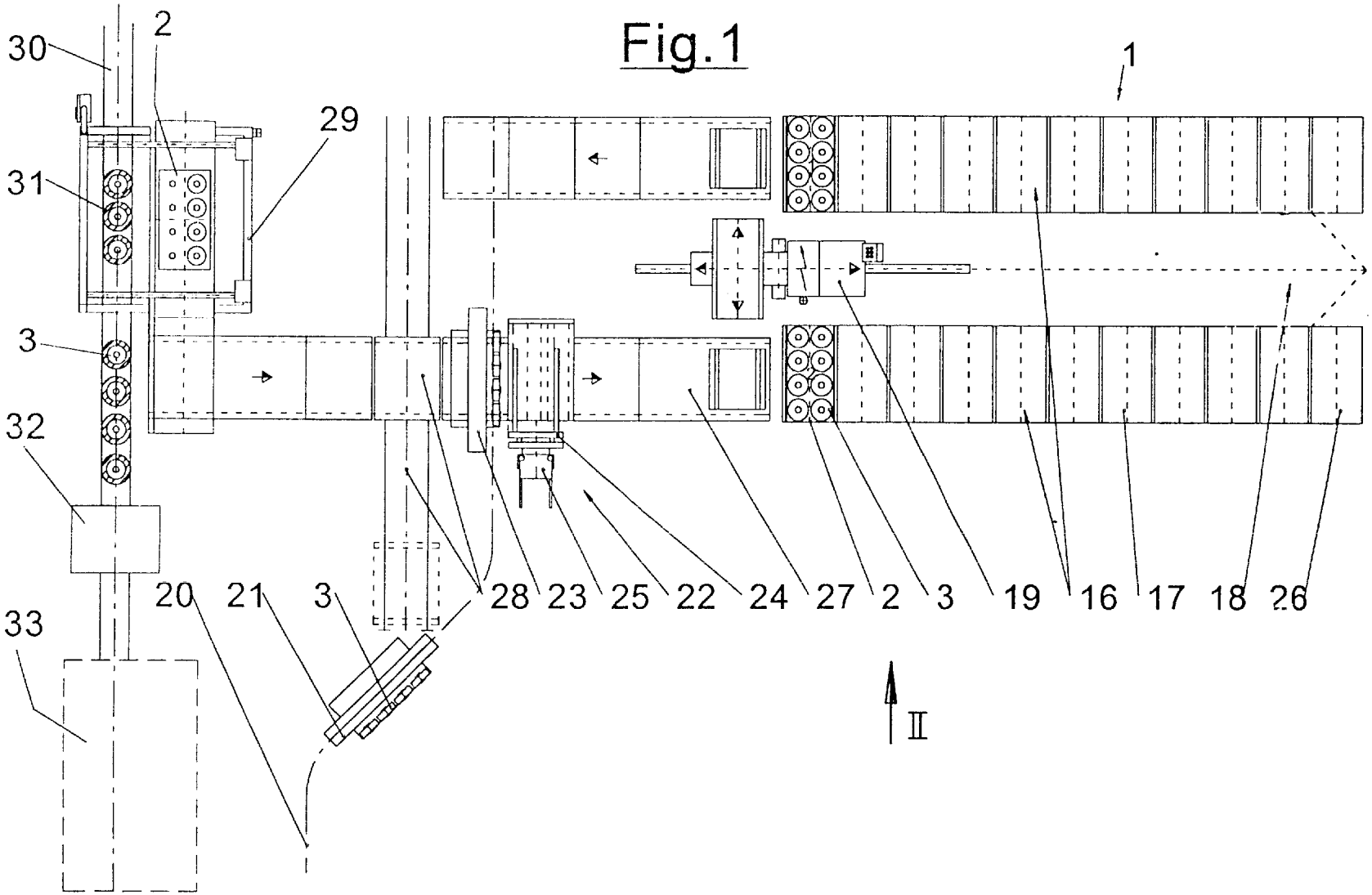
FIG. 1 is a schematic top view of a storing device with shelf storing means, an external feeder and unloading means.

Referring to the drawings in particular, the storing device 1 shown in the drawings is designed as shelf storing device for spools 3. The spools 3 are preferably filament spools that are produced in spinning mills. The storing device 1 involves besides the actual shelf storing device, also at least one delivery station 22 for connection to an external feeder 20, and optionally an unloading device 29. On the output side, a conveyor 30, a packaging means 33, especially a palletizing device, and optionally a foil packaging device 33 may additionally be present.

Figure 5:
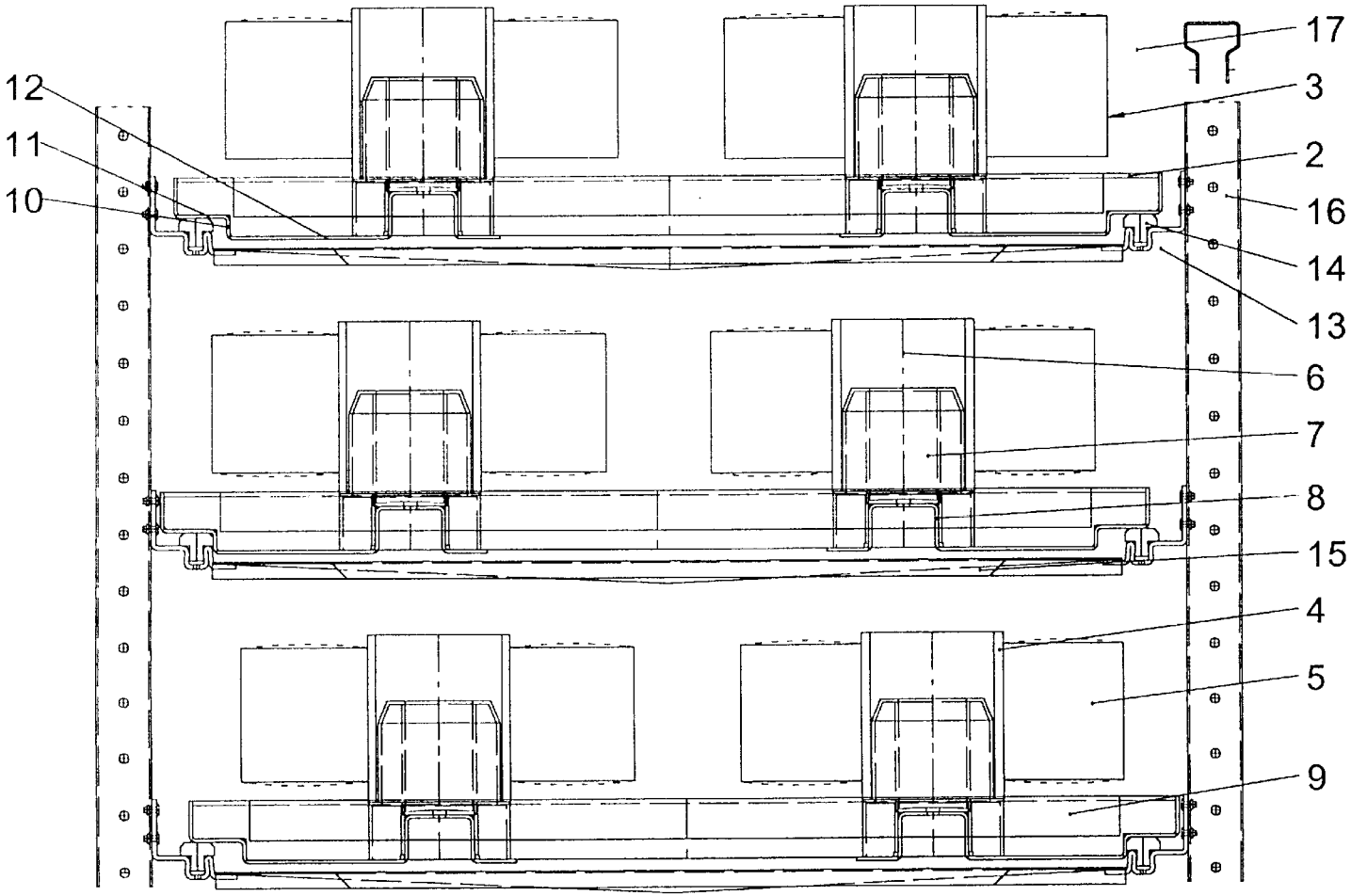
FIG. 5 is an enlarged, detailed front view of shelfbays with spool carriers and spools.

As FIG. 5 shows in detail, the individual spools 3 consist of a hollow cylinder-tubular spool core 4 made of cardboard or the like, onto which a winding 5 is drawn on the peripheral side. The winding 5 consists of fibers, yarns, or the like. In the direction of the central spool axis 6, the spool core 4 projects a bit over the winding 5 on both sides.

The spools 3 are held within the shelf storing device 1 on spool carriers 2, which are preferably designed as pallet-like shelves or so-called multitrays. As alternatives they may also have any other suitable shape. The spool carriers 2 preferably possess a plurality of stationary pins 7 or arbors, onto which the spools 3 are placed with the spool core 4. A plurality of such individually mobile spool carriers 2 are present within the shelf storing device 1.

The shelf storing device 1 has a plurality of shelves or shelf bays 16 with a plurality of bays 17. The bays 17 are designed for a horizontal storage of the spool carriers 2. FIG. 5 illustrates this arrangement. The spool carriers 2 adopt a preferably horizontal position, whereby the pins 7, in the stored position, preferably stand vertically upright.

The spools 3 are individually placed onto the pins 7, whereby each pin 7 carries only one spool 3. The length of the pins 7 is less than the length of the spool core. This results in a free space above the pins 7, via which the spool cores 4 can be grasped from inside and handled.

The pins 7 are arranged on broadened supporting rails 8, on which the spool cores 4 rest on the bottom side and are supported by a stationary spool axis 6. At the end side the supporting rails are connected to the shelf 2 by a circular, stable frame 9. As FIG. 1 illustrates, e.g., eight pins 7 are arranged on one spool carrier 2.

As FIG. 5 illustrates, the spool carriers 2 can have a bent section 10 on both lateral edges. This bent section 10 reduces the overall height and storage height, on the one hand, and, on the other hand, makes possible the arrangement of conveying surfaces 11, 12 that are separated in terms of space and are located at different heights for movements within the bays 17 and on different conveying tracks of the storing device 1. At the brackets of the shelves 16 supporting profiled sections 13 with sliding rails 14 are arranged at each bay 17. The sliding rails 14 work together with the associated sliding surfaces 11 on the bottom side of the bent sections 10. The running surfaces 12 for the other conveying areas are arranged on the bottom side of the lowered bottom area of the spool carrier 2 lying next to them. By means of this separation of the conveying surface and the sliding or running surfaces 12, the wear and tear within the bays 17 and the risk of contamination of the highly sensitive spools 3 accompanied with this are considerably reduced.

Moreover, the bays 17 are separated from one another. For this purpose, trays 15 are located put or placed between the supporting profiled sections 13. The spools 3 are thereby protected from one another in a contamination- and dust-proof manner.

Moreover, FIG. 5 shows an embodiment of the supporting profiled sections 13 that is especially favorable for production. These supporting profiled sections 13 are designed as bent and essentially L-shaped profiled sections. On their horizontal shoulder, they have a bulge projecting downwards and running longitudinally, which accommodates the foot of the sliding rails 14. In the simplest embodiment, the sliding rails 14 may be held therein by means of clamps, and may optionally be secured by means of screws. On an adjacent flange on the inside, trays 15 may be placed loosely and removably.

In their cross section, the sliding rails 14 have a mushroom-like shape. On the top side and inside, they have conducting surfaces, which cooperate with the bent section 10. As FIG. 5 illustrates, this shape of the rails makes possible a horizontal and lateral guiding of the spool carriers 2 within the bays 17.

The shelf storing device 1 may be designed in any other, suitable manner. FIGS. 1 through 4 show a preferred embodiment with two pairs of related shelf bays 16 and a lane 18 which lies between them, in which lane 18 a storage and retrieval unit for a high-bay warehouse 19 travels to and fro in the longitudinal direction, and conveys and removes the spool carriers 2 laterally in the horizontal bays 17. The storage and retrieval unit for a high-bay warehouse 19 is preferably rail mounted and has corresponding guides and running systems for this. It has a lateral conveyor that which can operate the adjacent shelf bays 16 to the left and right. The storage and retrieval unit for a high-bay warehouse 19 may be remote-controlled by means of a corresponding warehouse-overlapping and programmable control [not shown] or operated manually.

Within the shelf bays 16, the spool carriers 2 are conveyed and inserted or removed in the lying and horizontal position. In connection to the shelfbays 16, horizontal feed and output conveyors 7, 28 may likewise be present. Places of deposit 26 for an intermediate storage, service purposes or the like may also be present at suitable places.

In spinning mills, the spools 3 are often conveyed with vertical spool carriers for space reasons. For the connection of the shelf storing device 1 to one or more such external feeders 20, one or more delivery stations 22 are provided. The feeders 20 consist, e.g., of rail-mounted suspended conveyors, to which vertically hanging conveying carriers 21 are fastened. The spools 3 are arranged on the latter with lying or horizontal spool axis 6.

As FIGS. 1 through 4 illustrate, the delivery station 22 has a turning means 24 and optionally a delivery means 23 as well. The turning means 24 is used to bring the spool carriers 2 from a vertical position into a horizontal position. By means of the delivery means 23, the spools 3 may preferably be delivered together at one go from the conveying carrier 21 to a spool carrier 2 kept ready.

Figure 2:
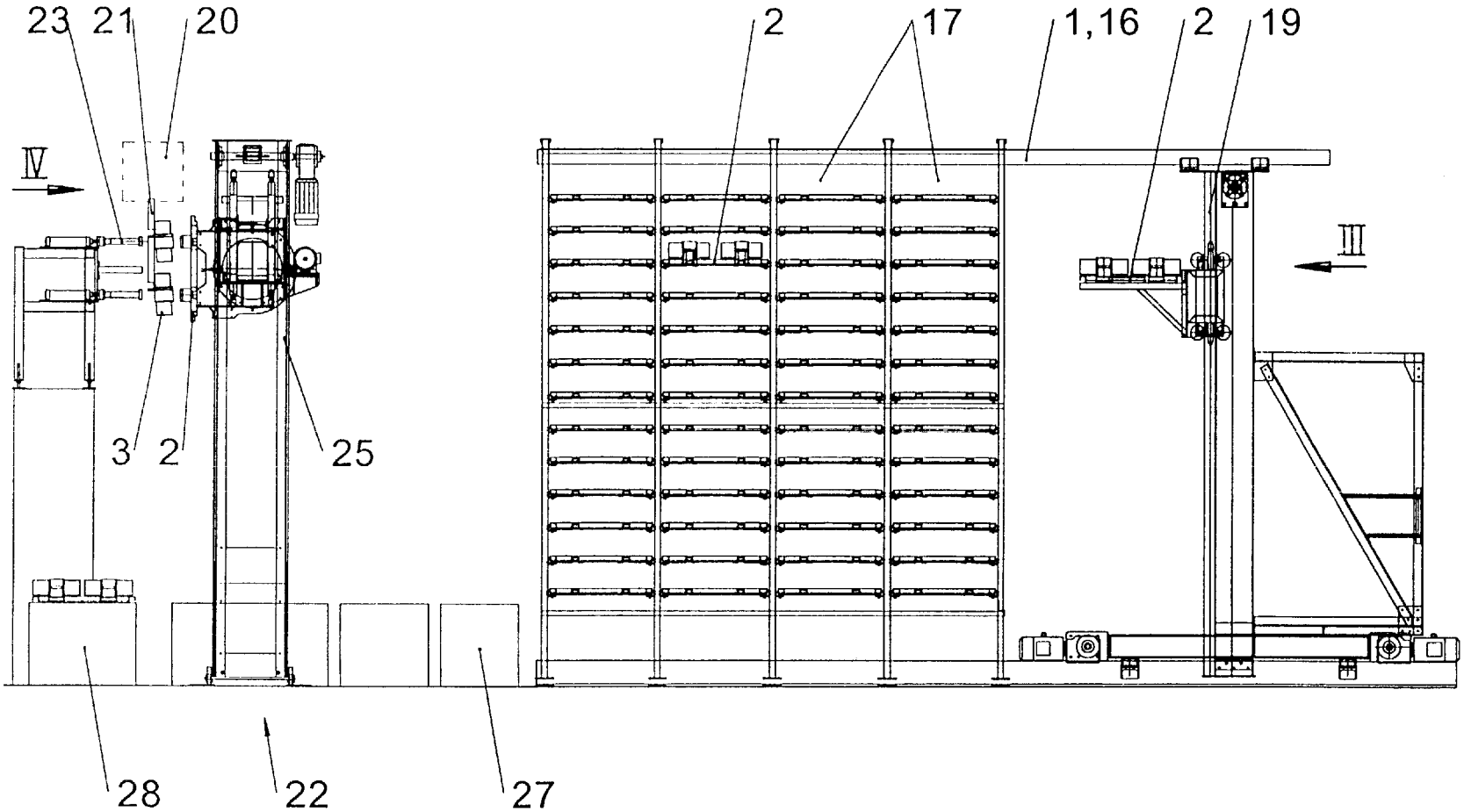
FIG. 2 is a lateral view of the storing device according to arrow II of FIG. 1.
Figure 3:
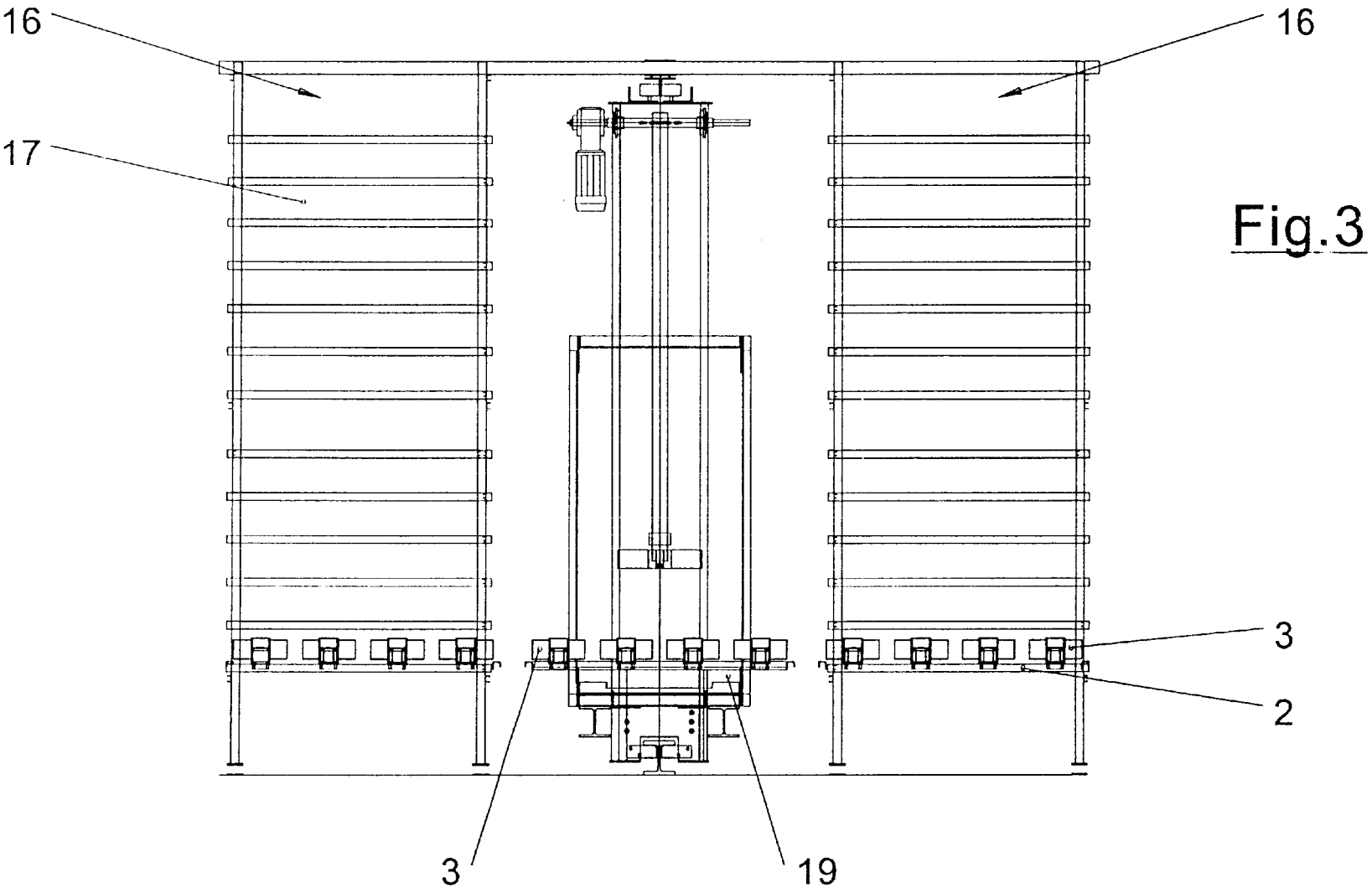
FIG. 3 is a front view of the storing device according to arrow III of FIG. 2.
Figure 4:
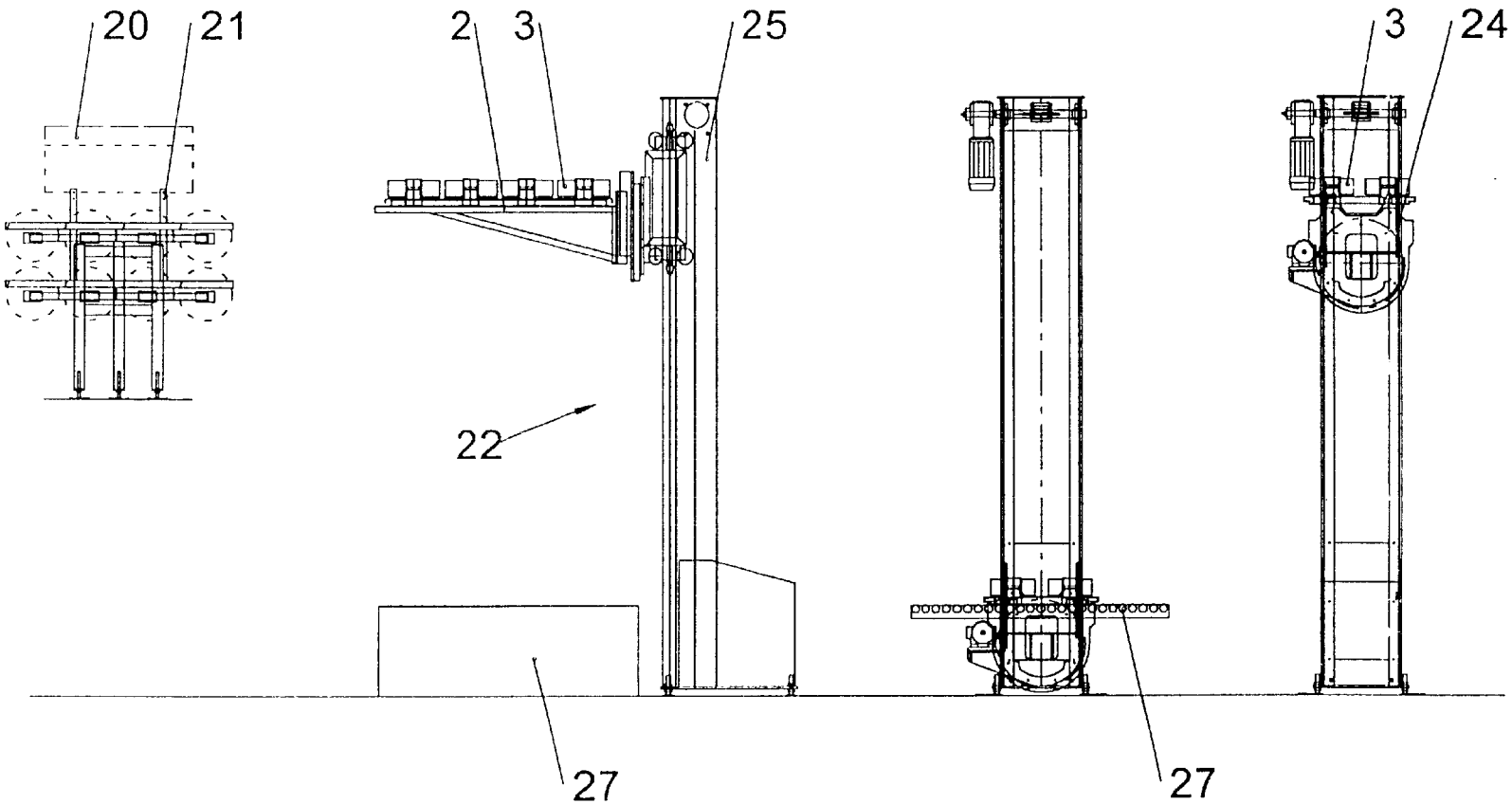
FIG. 4 is a rotated front view of the delivery station according to arrow IV of FIG. 2.

As is evident from the lateral views of FIGS. 2 and 4, the feeders 20 are arranged near the ceiling and at a considerable distance from the floor. The turning means 24 has a bracket 25, at which the turning mechanism is arranged movable up and down via a slide. The turning mechanism also involves suitable clamping means for retaining and releasing the spool carrier 2.

In the embodiment shown, the spools 3 are delivered from the conveying carrier 21 to the spool carrier 2. As an alternative, in a corresponding design of the unit, the spool carriers 2 may also circulate in the entire area of the unit, so that the completely loaded spool carriers 2 are delivered from the feeder 20 to the turning means 24.

For delivery, the slide of the turning means 24 is located at the top of the bracket 25, and it holds the spool carrier 2 in the vertical position. The delivery means 23 is likewise arranged in a raised and opposite position. It has a number of pins or plates which, in the delivery position shown in FIG. 2, slide the spools 3 from the conveying carrier 21 to the pins 7 of the spool carrier 2.

After delivery the turning means 24 rotates the spool carrier 2 into the horizontal position shown in FIG. 4 with spools 3 lying at the top. The slide of the turning means 24 travels downwards and delivers the spool carrier 2 to the feeding conveyor 27 on the floor, which extends the length of one shelf bay 16. The feeding conveyor 27 may have a plurality of intermediate or conveying positions, at which spool carriers 2 may be temporarily stored or retained. The feeding conveyor 27 may be designed, e.g., as a roller conveyor.

As FIG. 1 illustrates, the storage and retrieval unit for a high-bay warehouse 19 takes the spool carriers 2 from the feeding conveyor 27 and transports them into the shelf storing device 1. In the opposite direction there is arranged a similar parallel output conveyor 28 for the output of the spool carriers 2. Another output conveyor 28, e.g., a shuttle, may be connected to this at the end.

The output conveyor or output conveyors 28 may be connected to an unloading device 29, which removes the individual spools 3 from the spool carrier 2 and supplies them to further processing. For this purpose, the unloading device 29 may have a suitable unloading robot with gripping tools, which grasp the spool cores 4 at the free ends lying at the top individually or as a pack and remove them from the spool carrier 2. On the feeding and output conveyors 27, 28, as well as within the unloading device 29, the spool carriers 2 are moved and handled in the horizontal or in the lying position. The empty spool carrier 2 may again be passed back into the shelf storing device 1 via suitable conveying means and be held ready there at suitable collection and reserve positions for the next use.

Figure 6:
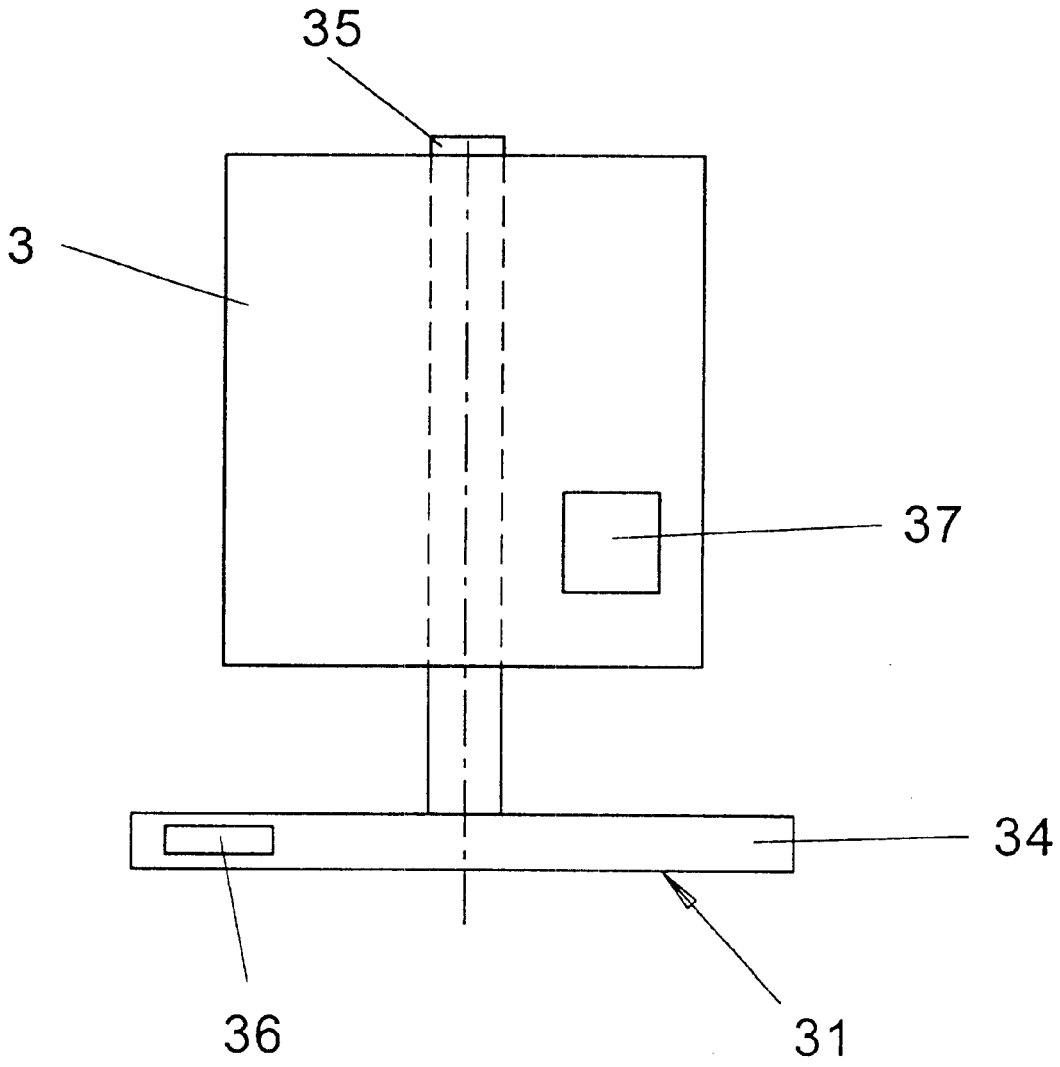
FIG. 6 is a lateral view of a monotray with spool.

As FIG. 1 illustrates, another conveyor 30 may be arranged at the unloading device 29 as well. Individual spool carriers, so-called monotrays 31, are moved separately on this conveyor. FIG. 6 shows a lateral view of the monotrays 31. The monotray 31 consists, e.g., of a conveying plate 34 that is circular at the bottom and that is guided and is moved separately in a suitable manner on the conveyor 30. For this purpose, the conveyor may be designed as a towing conveyor, a roller conveyor, or the like. On the horizontal conveying plate 34 is located a stationary pin 35, on which the spool 3 can be placed with its inner sleeve. Each monotray 31 preferably carries only one spool 3. A coding 36 for identifying the monotrays 31 may be present at the conveying plate 34 and/or the pin 35.

The monotrays 31 are also suitable and can be used as replacements for the above-described spool carriers 2 or multitrays. They are grouped into larger bundles accordingly and held together using a suitable device for warehousing.

During the removal, the unloading device 29 again isolates the spools 3 grouped on the shelves or multitrays 2, and it delivers them separately to the monotrays 31. The monotrays 31 may again be grouped into new bundles on the conveyor 30. In the operation of the conveyor 30, additional stations may be present. An inspection according to grade and other distinguishing criteria may be carried out on the isolated spools 3. In this case, the individual spools 3 may also be sorted and forwarded in a pure-grade manner via corresponding branched conveying paths. E.g., the spools 3 can be sorted according to grade A or B here. In addition, position corrections of the spools, small straightening operations, etc. may be made during the inspection.

E.g., a foil packaging device 32 is provided as an additional station on the conveying path. In this device 32, the individual spools 3 on the monotrays 31 are packaged with a foil, which, e.g., is wound around the spools 3 as a band and is then placed on the top and bottom sides of the spools by means of vacuum and is drawn into the spool core 4. In the foil packaging, the spools may also be provided with a label 37 which contains the data determined during the previous inspection and distinguishing features according to grade, color, etc. These data are managed by means of a plant-overlapping control (not shown) and are referred to for the further processing of the spools 3 and of the monotrays 31. The data of the tray coding 36 are fed into the control as well. The spool carriers can be identified by this coding 36, with which the other spool carriers 2 or multitrays 2 are also equipped, and they can be tracked on their path and their current movement and storage position. This may occur over various testing sites (not shown), at which the coding and optionally also the label 37 are read by a machine and the information are given to the control unit.

Further, a packaging means 33 may be downstream of the unloading device 29. This packaging means 33 is designed, e.g., as a palletizing means. The monotrays 31 are preferably sorted on the conveyor 31 and are supplied in a pure-grade manner to the packaging means 32. Here, the monotrays 31 may be grouped in the suitable bundle size, e.g., as a pack of five or a pack of nine. The palletizing means then takes the spools 3 in groups and moves them in layers to a made-ready pallet bottom or stacks a number of layers one on top of another. The finished pallet is then covered with a shrink wrap or the like and optionally provided with hoops. The finally packaged pallet may then be taken away.

Variations of the exemplary embodiment shown are possible in various manners. The bays 16 can be in a single column, and each may have its own storage and retrieval unit for high-bay warehouse. Omitting the special delivery stations 22, the storage and retrieval unit for high-bay warehouse can also take the spool carriers 2 or the spools 3 directly from the feeder 20. The feeder 20 may also be designed in another suitable manner and, e.g., in the simplest case, consist of fork lift trucks or other industrial trucks. It is also possible to convey and to handle the spool carriers outside the shelf storing device in the horizontal position, as a result of which the turning means may not be necessary. Further, the shape of the spool carriers themselves, as well as the supporting and guiding means in the shelf bays may vary.

While specific embodiments of the invention have been shown and described in detail to illustrate the application of the principles of the invention, it will be understood that the invention may be embodied otherwise without departing from such principles.

What is claimed is:

1. A process for storing spools with a plurality of spool carriers, the process comprising the steps of:

providing a plurality of spool carriers, each spool carrier for carrying plural spools with an upright spool axis;

providing a shelf storing device with horizontal bays and sliding rails for accommodating said spool carriers;

storing the spools in the shelf storing device with horizontal bays;

dividing the bays from one another to prevent contamination and dust with horizontal partitions disposed between vertically adjacent sliding rails;

removing the spools and delivering spools individually to respective monotrays with stationary pins, forwarding the spools individually to a conveyor and feeding the spools individually or with the formation of a new group to a packaging device.

2. The process in accordance with claim 1, wherein the spools are placed in groups onto the individually movable spool carriers, each of said carriers being a pallet carrier with a plurality of uniformly distributed stationary pins, each pin for carrying a spool.

3. The process in accordance with claim 1, further comprising providing a conveying carrier connected to an external feeder wherein, in a front of the shelf storage device, the spools are removed from the conveying carrier to the external feeder and are delivered to one of the spool carriers.

4. The process in accordance with claim 1, wherein the spools are supplied from an external feeder with a spool axis directed horizontally or diagonally, and are turned before the deliver to the spool carrier.

5. The process in accordance with the claim 1, wherein said step of removing the spools includes removing the spools from the storing device and delivering the spools horizontally together on one of the spool carriers on an output conveyer, and said step of delivering spools individually to respective monotrays includes unloading the spools separately by an unloading device with access from above.

6. A spool storing system for spools, the system comprising:

individually movable spool carriers; and a shelf storing device with horizontal bays provided for the accommodation of the individually movable spool carriers, with sliding rails in each of said horizontal bays, said sliding rails accommodating the spool carriers for storing the spools arranged in a storage position with a stationary spool axis and with dividing elements inserted between the horizontal bays, said spool carriers having separate and height-variable conveying surfaces for movement in said bays and on other conveying tracks.

7. A spool storing system in accordance with claim 6, wherein said spool carriers are pallet style shelves with a plurality of uniformly distributed stationary pins for the accommodation of spools.

8. A spool storing system in accordance with claim 7, wherein said pins each accommodate an individual spool core and said pins are shorter than the spool core.

9. A spool storing system in accordance with claim 6, wherein the spools are supported on a bottom at a spool core with a winding maintained in a suspended state.

10. A spool storing system in accordance with claim 6, wherein said bays have lateral supporting profiled sections with said sliding rails for said spool carriers and said dividing elements between the bays.

11. A spool storing system in accordance with claim 6, further comprising a storage and retrieval unit wherein said shelf storing device has a plurality of said bays with said storage and retrieval unit provides access for a high-bay warehouse.

12. A spool storing system in accordance with claim 11, further comprising a delivery station with a turning means for delivering said spool carriers between said storage and retrieval unit for high-bay warehouse and an external feeder.

13. A spool storing system in accordance with claim 12, wherein said delivery station has a delivery means, with which said spools are delivered by a conveying carrier at the external feeder to said spool carrier.

14. A spool storing system for spools, the system comprising:

individually movable spool carriers;

a shelf storing device with horizontal bays provided for the accommodation of the individually movable spool carriers, with sliding rails in each of said horizontal bays, said sliding rails accommodating the spool carriers for storing the spools arranged in a storage position with a stationary spool axis and with dividing elements inserted between the horizontal bays;

at least one output conveyor moving said spool carriers horizontally and at least one unloading device for unloading said spools individually with access from above; and a conveyor with individually movable monotrays arranged at said unloading device.

15. A spool storing system in accordance with claim 14, wherein said monotrays have a conveying plate with a stationary pin for the accommodation of a spool.

16. A spool storing system in accordance with claim 14, wherein said monotrays have a coding that can be read by machine.

17. A spool storing system in accordance with claim 14, wherein said conveyor is connected with a packaging means for the collection and packaging of said spools in groups.

18. A spool storing system in accordance with claim 17, further comprising: a foil packaging device for packaging individual spools on said monotrays wherein, said foil packaging device is arranged in front of said packaging means.

19. A process for storing spools, comprising the steps of:

providing a multi-spool carrier for carrying a plurality of spools with an upright spool axis;

providing a spool storage device with horizontal bays and sliding rails for accommodating the spool carrier;

moving the multi-spool carrier out of the storage horizontally and on to an output conveyor;

unloading the spools individually from the output conveyor using an unloading device with access to the spools from above the multi-spool carrier, the spools which had been associated on the multi-spool carrier being separated upon removal;

feeding individual spools to respective mono-spool carriers, each mono-spool carrier having a single upright pin for holding the spool with and upright spool axis; and moving the mono-spool carrier on a conveyor.

20. A storage arrangement for spools, the storage arrangement for spools, the storage arrangement comprising:

a multi-spool carrier for carrying a plurality of spools with an upright spool axis;

a storage device with horizontal compartments and sliding rails to accommodate one or more of said multi-spool carriers;

an output conveyor for receiving horizontally output multi-spool carriers from said storage device;

at least one unloading device for unloading spools individually from said multi-spool carrier from above said multi-spool carrier;

individually movable mono-spool carriers, each are said mono-spool carriers for receiving a single spool and having an upright pin for supporting a single spool; and a mono-spool conveyor for moving mono-spool carriers.

21. A storage system according to claim 20, wherein mono-spool carrier include a lower support having a machine readable code readable by an inspecting device.

22. A storage facility arrangement according to claim 20, further comprising one of a machine inspection unit and a packing unit for enveloping spools.

* * * * *